US005378129A

United States Patent [19]

Dunaevsky et al.

[11] Patent Number: 5,378,129

[45] Date of Patent: Jan. 3, 1995

[54] ELASTIC UNLOADER FOR SCROLL MACHINES

[75] Inventors: Valery Dunaevsky, Fairview Park; Mark Bass, Sidney, both of Ohio

[73] Assignee: Copeland Corporation, Sidney, Ohio

[21] Appl. No.: 163,345

[22] Filed: Dec. 6, 1993

[51] Int. Cl.[6] ..... F01C 1/04; F01C 17/06

[52] U.S. Cl. ..... 418/55.5; 418/57

[58] Field of Search ..... 418/55.5, 57

[56] References Cited

U.S. PATENT DOCUMENTS

| | | | |
|---|---|---|---|
| 4,300,875 | 11/1981 | Fischer et al. | 418/57 |
| 4,767,293 | 8/1988 | Caillat et al. | 418/55.5 |
| 4,954,057 | 9/1990 | Caillat et al. | 418/55.6 |
| 5,011,384 | 4/1991 | Grunwald et al. | 418/55.5 |
| 5,197,868 | 3/1993 | Caillat et al. | 418/57 |

FOREIGN PATENT DOCUMENTS

| | | | |
|---|---|---|---|
| 2-86976 | 3/1990 | Japan | 418/55.5 |
| 2-91489 | 3/1990 | Japan . | |
| 2123291 | 5/1990 | Japan | 418/55.5 |

*Primary Examiner*—John J. Vrablik

*Attorney, Agent, or Firm*—Harness, Dickey & Pierce

[57] ABSTRACT

A scroll machine has an elastomeric member placed between the drive shaft and an unloader drive bushing of the scroll machine. The elastomeric member provides limited transverse movement between the drive shaft and the orbiting scroll member which is driven by the drive bushing. The limited transverse movement permits radial compliant engagement of the scroll wraps of the scroll machine. In one embodiment, the elastomeric member is connected to the drive shaft and a bearing plate is placed between the elastomeric member and the drive bushing for driving engagement. In another embodiment, the elastomeric member is connected to the drive bushing and a bearing plate is placed between the elastomeric member and the drive shaft for driving engagement.

24 Claims, 2 Drawing Sheets

ELASTIC UNLOADER FOR SCROLL MACHINES

FIELD OF THE INVENTION

The present invention relates to scroll machines having a radially compliant orbiting scroll drive arrangement. More particularly, the present invention relates to a scroll machine having an improved radially compliant orbiting scroll drive arrangement which incorporates an elastomeric member to facilitate the compliance of the orbiting scroll.

BACKGROUND AND SUMMARY OF THE INVENTION

A typical type scroll compressor comprises orbiting and non-orbiting scroll members having interfitting spiral vanes, the flanks of the vane on one member being in sealing contact with the flanks of the vane on the other member. The vanes define fluid-containing pockets which change in volume as one scroll member orbits with respect to the other scroll member.

Orbital movement of the orbiting scroll is generally provided by an elongated axial crankshaft journaled for rotation in at least one bearing of the compressor. One end of the crankshaft typically has an eccentric crank pin mounted in a hub on the orbiting scroll member, whereby rotation of the crankshaft causes the orbiting scroll member to orbit with respect to the non-orbiting scroll member. In a radially compliant driving arrangement, an unloader bushing may be provided between the crank pin and the drive bearing located in the hub on the orbiting scroll. The crank pin is normally provided with a flat surface for drivingly engaging a corresponding flat surface located on the unloader bushing. The design of the crank pin and the unloader bushing are such that the two flat surfaces provide for a limited amount of sliding motion and thus radial compliance between the crank pin and the unloader bushing. This limited sliding motion permits radial movement of the orbiting scroll with respect to the crank pin and thus unloading of the scroll machine. The angle the flat driving surface on the crank pin may be chosen so that a slight centrifugal force component is introduced to the orbiting scroll by the driving of the crank pin in order to enhance flank sealing. During operation of the compressor, the radial compliancy is advantageous for various reasons, including permitting deflection or the orbiting scroll when debris or liquid coolant are encountered in the compression process and the aiding in the elimination of reverse rotation of the scroll compressor at stop by creating a gap between the non-orbiting and orbiting scroll vanes to release the high pressure gas from the central volume and high pressure pockets of the compressor. This unloading of the scroll machine releases the high pressure gasses to the suction area of the compressor.

As compressor loading increases, due to compressed gas forces, the forces on the two flat driving surfaces can become excessive such that it becomes difficult to insure continuous radial sliding movement between the unloader bushing and the crank pin. In order to prevent damaging wear and/or excessive noise and vibration, the interfacing flat surfaces of the crank pin and the unloader bushing require tight control of both the dimensions and the surface finish requirements of the two surfaces. In addition, lubrication of the two surfaces is a necessity in order to lower the coefficient of friction between the two surfaces and thus the load required for sliding movement between the two surfaces. As the compressor loading increases, the lubrication between the two flat surfaces thus becomes more difficult.

It is therefore a primary objective of the present invention to provide a driving arrangement which obviates the aforesaid problems which can occur under high load conditions, thereby increasing unloader reliability and overall performance.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DESCRIPTION OF THE PREFERRED EMBODIMENTS

Figure 1:
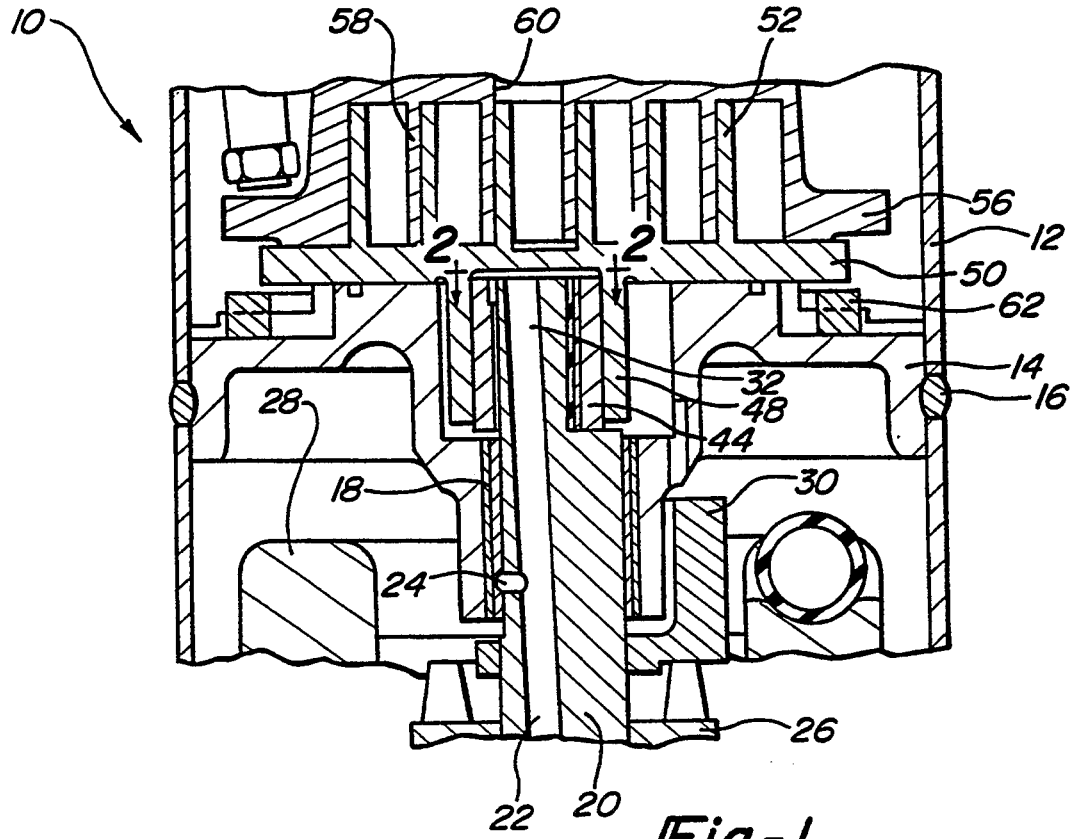
FIG. 1 is a partial vertical cross-sectional view of a hermetic scroll compressor embodying the principles of the present invention.

Although the orbiting scroll assembly of the present invention is applicable to different types of scroll machinery, it is illustrated for exemplary purposed in a scroll compressor, and in particular in a hermetic refrigerant compressor. Referring now to the drawings in which like reference numerals designate like or corresponding parts throughout the several views, there is shown in FIG. 1, the essential components of the refrigerant compressor which is designated generally by reference numeral 10. Compressor 10 comprises a hermetic shell 12, a main bearing housing 14 welded to shell 12 by a plurality of welds 16, a bearing assembly 18 carried by housing 14 and having journaled therein a crankshaft 20. Crankshaft 20 has a slightly inclined upwardly axially extending oil feed passageway 22 open at the upper end of crankshaft 20 and a radial oil feed passageway 24 for feeding lubricant to bearing 18. Crankshaft 20 is affixed at its lower portion to a motor rotor 26 which is energized by the usual motor stator (not shown), the upper windings 28 of which are seen in FIG. 1. A counterweight 30 may be affixed to crankshaft 20 above motor rotor 26. The bottom of crankshaft 20 (not shown) can also be journaled in a bearing in the usual manner if desired.

The upper end of crankshaft 20 comprises an eccentric crank pin 32 having on one face thereof a generally flat driving surface 34 bonded to an elastomeric member 36 which is in turn bonded to a bearing plate 38. Bearing plate 38 drivingly engages a flat driven surface 40 disposed on the wall of a bore 42 in an unloader drive bushing 44. Drive bushing 44 is rotatably journaled within a bore 46 disposed in a hub 48 affixed to an orbiting scroll member 50 having a spiral wrap 52. The outer surface of drive bushing 44 and bore 46 define a conventional journal bearing 54. Meshing with orbiting scroll member 50 in the usual manner is a non-orbiting scroll member 56 having a spiral wrap 58 and a discharge passage 60. Relative rotational movement between orbiting scroll 50 and non-orbiting scroll 56 is prevented by means of an Oldham coupling 62 disposed between orbiting scroll 50 and bearing housing 14.

The orbiting drive mechanism is lubricated by means of a conventional oil pump located at the lower end of crankshaft 20 in the usual oil sump (not shown) disposed in the bottom of hermetic shell 12. Oil is pumped by the oil pump up passageway 22 to all the areas within compressor 10 which require lubrication. Excess oil is pumped out of the upper open end of passageway 22 generally along path 64 across the upper end of crank pin 32 and drive bushing 44 into a recess or slot 66 disposed in the upper surface of drive bushing 44, which in turn communicates with a flat 68 on the external surface of drive bushing 44 which defines a passageway for the oil to be transmitted to journal bearing 54. Flat 68 is on an unloaded portion of journal bearing 54. As described up to this point, the compressor (including the portions not shown) is the same as that described in assignee's U.S. Pat. No. 4,767,293, the disclosure of which is hereby incorporated herein by reference, except for elastomeric member 36 and its associated bearing plate 38.

As discussed in greater detail in the aforementioned patent, the rotational driving force of a crank pin is transmitted to a drive bushing by virtue of the inter-engagement of a flat surface on the crank pin and a flat surface on the drive bushing. Because of the relatively high unit loads between the above surfaces, the load required for a sliding movement between these surfaces, and correspondly between crank pin 32 and driving bushing 44, becomes excessive. This would normally lead the prior art to tight control of dimensions, surface finish requirements and lubrication of the contacting surface if sliding movement is to occur. In the present invention, elastomeric member 36 and bearing plate 38 are disposed between flat surface 34 on crank pin 32 and flat surface 40 on driving bushing 44, with the elastomeric member attached to surface 34 and plate 38. The present invention by incorporating elastomeric member 36 between crank pin 32 and drive bushing 44 with or without bearing plate 38 can easily control the load required for the movement between the two components by selecting the appropriate stiffness of elastomeric member 36. The geometrical and mechanical characteristics of elastomeric member 36 are selected in such a way that resistance to lateral displacement is less than the load required to slide the exterior surface of elastomeric member 36 when bearing plate 38 is not used and the exterior surface of bearing plate 38 when bearing plate 38 is used across flat surface 40 on drive bushing 44. The elimination of the sliding movement between the exterior surface of bearing plate 38 and flat surface 40 eliminates the associated frictional losses, wear, lubrication, flatness and tight dimensional requirements.

Figure 2:
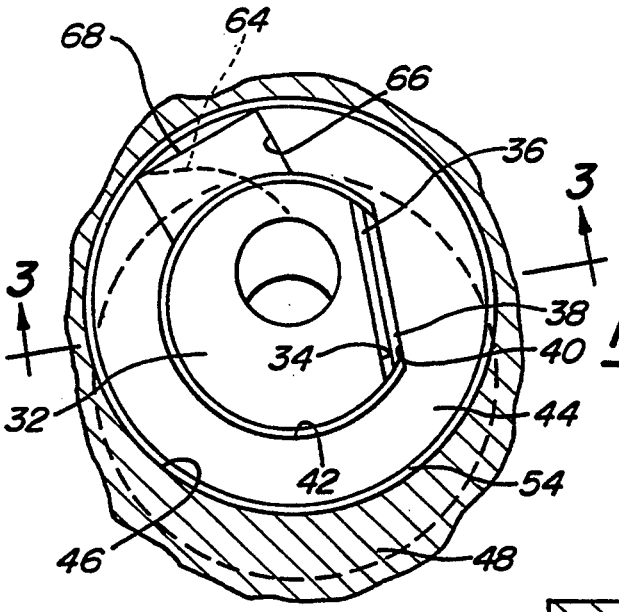
FIG. 2 is an enlarged fragmentary cross-sectional view taken along line 2—2 in FIG. 1.

The present invention transmits the rotational driving force of crank pin 32 to drive bushing 44 by virtue of the inter-engagement of the exterior surface of bearing plate 38 and flat surface 40 of drive bushing 44 in a similar manner to the transmission of driving force between the flat surfaces of the aforementioned patent. In addition, as can be seen in FIG. 2, the pans are configured so that relative movement between crank pin 32 and drive bushing 44 is possible in a direction transverse to the primary load force without any sliding of drive bushing 44 with respect to crank pin 32. Drive bushing 44 in conjunction with crank pin 32 thus provides both a drive and an unloading function with the movement taking place between crank pin 32 and drive bushing 44 due to the deflection of elastomeric member 36. The reduction of resistance to the lateral displacement of drive bushing 44 and thus orbiting scroll 50 with respect to crank pin 32 will allow both the separation of the flanks of the scroll wraps when solid or liquid material is inserted as well as allowing the compressed gas radial separating forces to separate the flanks of the two scrolls before the rotation of the compressor stops. This separation of flanks before the rotation of the compressor stops will allow the high pressure gas from the central volume and the high pressure pockets to escape towards the suction side of the compressor thus eliminating the gas power which causes reverse rotation after stop.

Figure 3:
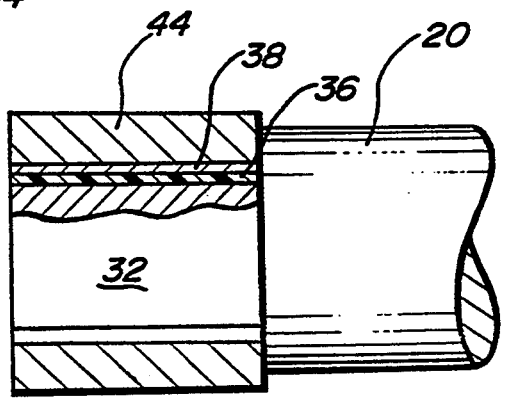
FIG. 3 is an enlarged fragmentary partial cross-sectional view taken along line 3—3 in FIG. 2.
Figure 4:
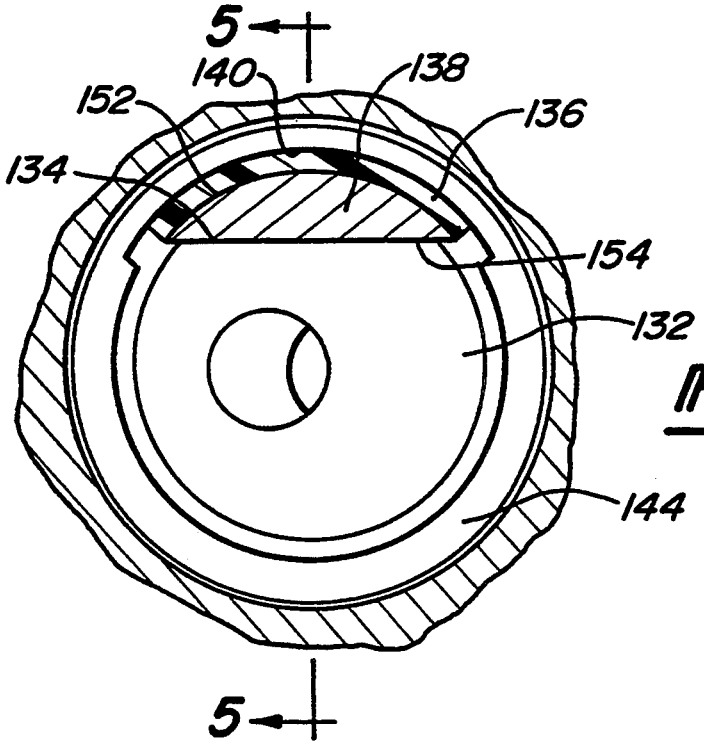
FIG. 4 is an enlarged fragmentary cross-sectional view similar to that of FIG. 2 but according to another embodiment of the present invention.
Figure 5:
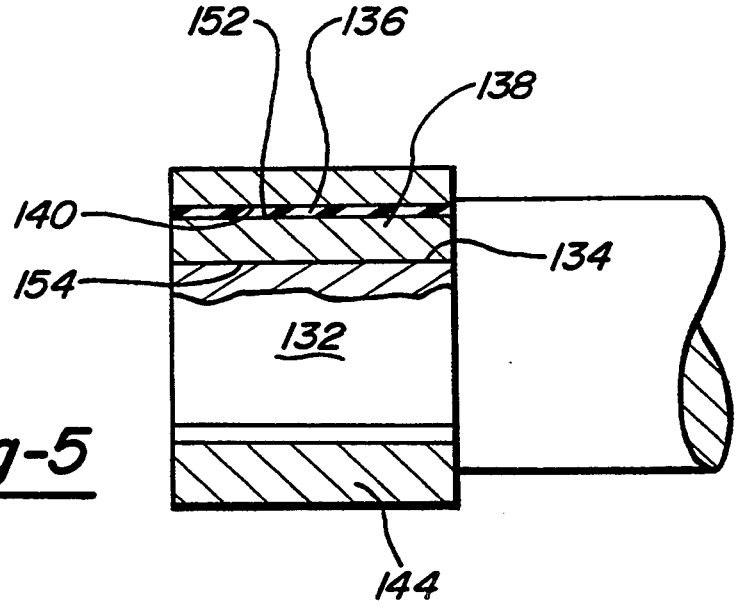
FIG. 5 is an enlarged fragmentary partial cross-sectional view taken along line 5—5 of FIG. 4.

FIGS. 4 and 5 show another embodiment of the present invention. In this embodiment, elastomeric member 136 and bearing plate 138 are disposed between flat surface 134 on crank pin 132 and curved surface 140 on drive bushing 144. Rather than crank pin 132 being bonded to elastomeric member 136, curved surface 140 of drive bushing 144 is bonded to elastomeric member 136 which is in turn bonded to bearing plate 138. Bearing plate 138 as shown in FIG. 4 is a D-shaped member having a curved surface 152 for mating with elastomeric member 136 and a flat surface 154 for mating with flat surface 134 on crank pin 132. Therefore, this embodiment of the present invention transmits the rotational driving force of crank pin 132 to drive bushing 144 by virtue of the inter-engagement of flat surface 134 on crank pin 132 and flat surface 154 of bearing plate 138 in a similar manner to the transmission of driving force between the flat surfaces of the embodiment shown in FIGS. 2 and 3. As can be seen in FIG. 4, the pans are configured so that relative movement between crank pin 132 and drive bushing 144 is possible in a direction transverse to the primary load force. This movement and the operation of this embodiment is similar to the movement described above for the embodiment shown in FIGS. 2 and 3 and it provides the same unloading features as well as the advantages described for the embodiment shown in FIGS. 2 and 3.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a first scroll member and a second scroll member mounted for orbital movement with respect to one another in an inter-meshed relationship;

a powered drive shaft having a generally flat driving surface for causing said relative orbital movement;

a drive bushing drivingly connected to one of said scroll members;

a driven surface on said drive bushing, said driving surface driving said driven surface to cause said one scroll member to orbit with respect to the other of said scroll members; and an elastomeric member disposed between said driving and driven surfaces for providing limited movement between said drive shaft and said one scroll member due to the deflection of said elastomeric member, said limited movement being in a direction providing radial compliance to said one scroll member.

2. The scroll machine according to claim 1 wherein said elastomeric member is secured to said drive shaft.

3. The scroll machine according to claim 2 wherein said elastomeric member is bonded to said drive shaft.

4. The scroll machine according to claim 1 wherein said elastomeric member is secured to said drive bushing.

5. The scroll machine according to claim 4 wherein said elastomeric member is bonded to said drive bushing.

6. The scroll machine according to claim 1 wherein said drive member further comprises a bearing plate disposed between said elastomeric member and said drive bushing.

7. The scroll machine according to claim 6 wherein said elastomeric member is secured to said bearing plate.

8. The scroll machine according to claim 7 wherein said elastomeric member is bonded to said bearing plate.

9. The scroll machine according to claim 1 wherein said drive member further comprises a bearing plate disposed between said elastomeric member and said drive shaft.

10. The scroll machine according to claim 9 wherein said elastomeric member is secured to said bearing plate.

11. The scroll machine according to claim 10 wherein said elastomeric member is bonded to said bearing plate.

12. The scroll machine according to claim 1 wherein said driven surface is generally flat.

13. A scroll machine comprising:

a first scroll member;

a second scroll member mounted for orbital movement with respect to said first scroll member, said second scroll member having a driven portion, said scroll members having spiral scroll wraps in an intermeshed relationship;

a rotatable powered drive shaft having a driving portion including a flat driving surface, said driving and driven portions being arranged with one disposed within the other;

a drive bushing disposed between and drivingly interconnecting said driving and driven portions;

an elastomeric member for providing limited transverse movement between said drive shaft and said second scroll member due to the deflection of said elastomeric member, said limited transverse movement permitting radial compliant engagement of said scroll wraps, said elastomeric member being disposed between said drive shaft and said drive bushing; and a bearing plate disposed between said elastomeric member and said drive bushing, said drive bushing being connected to said bearing plate by means of a driving surface on said bearing plate drivingly engaging a driven surface on said drive bushing.

14. The scroll machine of claim 13 wherein said elastomeric member is secured to said drive shaft.

15. The scroll machine of claim 14 wherein said elastomeric member is bonded to said drive shaft.

16. The scroll machine of claim 13 wherein said elastomeric member is secured to said bearing plate.

17. The scroll machine of claim 16 wherein said elastomeric member is bonded to said bearing plate.

18. The scroll machine of claim 13 wherein said driving surface of said bearing plate and said driven surface of said drive bushing are generally flat.

19. A scroll machine comprising:

a first scroll member;

a second scroll member mounted for orbital movement with respect to said first scroll member, said second scroll member having a driven portion, said scroll members having spiral scroll wraps in an intermeshed relationship;

a rotatable powered drive shaft having a driving portion, said driving and driven portions being arranged with one disposed within the other;

a drive bushing disposed between and drivingly interconnecting said driving and driven portions;

an elastomeric member for providing limited transverse movement between said drive shaft and said second scroll member due to the deflection of said elastomeric member, said limited transverse movement permitting radial compliant engagement of said scroll wraps, said elastomeric member being disposed between said drive shaft and said drive bushing; and a bearing plate disposed between said elastomeric member and said drive shaft, said drive shaft being connected to said bearing plate by means of a driven surface on said bearing plate drivingly engaging a generally flat driving surface on said driving portion of said drive shaft.

20. The scroll machine of claim 19 wherein said elastomeric member is secured to said drive bushing.

21. The scroll machine of claim 20 wherein said elastomeric member is bonded to said drive bushing.

22. The scroll machine of claim 19 wherein said elastomeric member is secured to said bearing plate.

23. The scroll machine of claim 21 wherein said elastomeric member is bonded to said bearing plate.

24. The scroll machine of claim 19 wherein said driven surface on said bearing plate is generally flat.

* * * * *

UNITED STATES PATENT AND TRADEMARK OFFICE

CERTIFICATE OF CORRECTION

PATENT NO. : 5,378,129

DATED : January 3, 1995

INVENTOR(S) : Valery Dunaevsky and Mark Bass

It is certified that error appears in the above-indentified patent and that said Letters Patent is hereby corrected as shown below:

Column 1, line 41, after "angle" insert -- on --.

Column 1, line 47, "or" should be -- of --.

Column 3, line 66, "pans" should be -- parts --.

Column 4, line 39, "pans" should be -- parts --.

Signed and Sealed this

Sixth Day of June, 1995

*Attest:*

*Attesting Officer*

BRUCE LEHMAN

*Commissioner of Patents and Trademarks*